US006620279B2

(12) United States Patent
Lindsay et al.

(10) Patent No.: US 6,620,279 B2
(45) Date of Patent: Sep. 16, 2003

(54) AUTOMATED FOLD AND SEAL APPARATUS

(75) Inventors: Wayne R. Lindsay, Barrington, NH (US); Brett A. Lindsay, Somersworth, NH (US)

(73) Assignee: Bri-Lin, Incorporated, Rochester, NH (US)

( * ) Notice: Subject to any disclaimer, the term of this patent is extended or adjusted under 35 U.S.C. 154(b) by 168 days.

(21) Appl. No.: 09/849,936

(22) Filed: May 4, 2001

(65) Prior Publication Data

US 2002/0162621 A1 Nov. 7, 2002

(51) Int. Cl.[7] ..... B31B 1/26; B31B 21/06

(52) U.S. Cl. ..... 156/227; 156/442.1; 156/442.2; 156/443; 156/538; 493/243; 493/249; 493/267; 493/421

(58) Field of Search ..... 156/227, 442.1, 156/441.5, 442.2, 443, 555, 582, 290, 580, 538; 493/216, 419, 420, 421, 243, 249, 267

(56) References Cited

U.S. PATENT DOCUMENTS 4,875,965 A * 10/1989 Marzullo ..... 156/442.1
5,626,710 A * 5/1997 Moll ..... 156/477.1
6,264,592 B1 * 7/2001 Lindsay ..... 493/216
6,340,406 B1 * 1/2002 Parker et al. ..... 156/442.1

* cited by examiner

*Primary Examiner*—Richard Crispino
*Assistant Examiner*—Cheryl N. Hawkins
(74) *Attorney, Agent, or Firm*—Davis & Bujold, PLLC

(57) ABSTRACT

A folding and sealing apparatus comprising a housing supporting a feed platform for feeding a supply of pre-glued forms to the folding and sealing apparatus. The housing accommodating a first roller, a second roller, a third roller and a fourth roller, and the first and second rollers forming a first nip, the second and third roller forming a second nip and the third and fourth roller forming a third nip. A motor drives at least one of the rollers via a drive mechanism. The first roller is a spring biased roller to facilitate feeding of the pre-glued form while the second, third and the fourth rollers are all fixedly mounted to the housing so that the second nip and the third nip both provide a sufficient sealing pressure to the folded form, as the folded form passes through the second and the third nips, to facilitate both folding and sealing of the folded form. A collection bin is provided adjacent the third nip for collecting the folded and sealed forms upon exiting from the folding and sealing apparatus.

20 Claims, 9 Drawing Sheets

AUTOMATED FOLD AND SEAL APPARATUS

FIELD OF THE INVENTION

The present invention relates to an automated apparatus which facilitates both folding and sealing of a pre-glued form by passing the pre-glued form through a plurality of pressure rollers to sequentially fold and seal the pre-glued form into a desired folded configuration.

BACKGROUND OF THE INVENTION

In the prior art, a variety of folding apparatuses are conventional used and well known in the art for folding pre-glued forms. In addition, a variety of separate sealing apparatuses are also conventional used and well known in the art for sealing pre-glued forms. However, none of the heretofore known apparatuses facilitate both folding of a pre-glued form and sealing of a pre-glued form during a single pass of the form through a sealing and folding apparatus. Moreover, generally at least four rollers are required to facilitate folding of a pre-glued form while at least two additional rollers are required to facilitate sealing of the folded pre-glued form in its folded configuration.

With reference to FIGS. 1–3, the basic folding arrangement for three well known pre-glued forms 1 will be briefly discussed. Turning first to FIG. 1, the single folded configuration for the pre-glued form is shown. According to the single fold, a pre-glued form, which typically measures 8½ inches wide by either 11 inches, 14 inches or 17 inches long is folded. The pre-glued form is passed through a folding apparatus which folds, in a conventional fashion, the pre-glued form in half. A perimeter edge of a first surface of a top half 8 of the pre-glued form is provided with a first component of a pressure sensitive micro-encapsulated epoxy or adhesive 4 while a perimeter edge of the lower half 10 of the first surface is provided with a second mating component of a pressure sensitive micro-encapsulated epoxy or adhesive 6. Once the pre-glued and folded form is folded in half and then subjected to sufficient sealing pressure, the micro-encapsulated first and second components 4, 6 of the pressure sensitive epoxy or adhesive are released from their respective micro-capsules and mix and bonded with one another to seal the folded form in its folded in half configuration.

Turning now to FIG. 2, a second folded configuration, namely a Z-shaped fold will now be briefly discussed. According to this configuration, as with the previous embodiment, selected areas of opposed perimeter edge of a first surface of a top panel 12 of the pre-glued form 1 are provided with a first component of a pressure sensitive micro-encapsulated epoxy or adhesive 4 while selected areas of opposed perimeter side edge of an adjacent intermediate panel 14 on the same surface are provided with a second mating component of a pressure sensitive micro-encapsulated epoxy or adhesive 6. In addition, an opposed perimeter side edges of a rear surface of the intermediate panel 14 of the pre-glued form 1 is provided with a first component of a pressure sensitive micro-encapsulated epoxy or adhesive 4 or 6 while adjacent perimeter side edges of the lower panel 16 are provided with a second mating component of a pressure sensitive micro-encapsulated epoxy or adhesive 4 or 6. Once the pre-glued and folded form 1 is properly folded and subjected to a sufficient sealing pressure, the micro-encapsulated first and second components 4, 6 of a pressure sensitive epoxy or adhesive are released from their respective micro-capsules and mix and bonded with one another to seal the Z shaped form 1 in its folded configuration.

Turning now to FIG. 3, a third folded configuration, namely a letter type fold will now be briefly discussed. According to this configuration, as with the previous embodiment, opposed perimeter side edges of a top panel 8 of the front surface of the pre-glued form 1 and opposed perimeter side edges of a bottom panel 12 of the front surface of the pre-glued form 1 are both provided with a first component of a pressure sensitive micro-encapsulated epoxy or adhesive 4 while opposed perimeter side edges of an intermediate panel 10 of the front surface are provided with a second mating component of a pressure sensitive micro-encapsulated epoxy or adhesive 6. In addition, opposed perimeter side edges of a rear surface of either the top panel 8 or the bottom panel 12 of the pre-glued form 1 are provided with a second mating component of a pressure sensitive micro-encapsulated epoxy or adhesive 6. Once the pre-glued form 1 is properly folded and subjected to a sufficient sealing pressure, the micro-encapsulated first and second components 4, 6 of a pressure sensitive epoxy or adhesive are released from their respective micro-capsules and mix and bonded with one another to seal the Z shaped form 1 in its folded configuration.

With reference now to FIG. 4, a brief description concerning a prior art apparatus for folding one of the pre-glued form 1 described above will now be discussed. As can be seen in this Figure, the prior art folding apparatus 22 comprises four identically sized rollers 24, 26, 28 and 30 which are arranged to form three nips 32, 34 and 36 between each respective mating pair of the rollers. The first nip 32 is an intake nip which feeds the pre-glued form 1 to be folded from an infeed table or platform 38 to a fold channel tray which, in combination with the first nip and the second nip, facilitates formation of a first fold for the pre-glued form 1. As a leading edge of the folded pre-glued form 1 exits from the second nip 34, it is conveyed toward a second stop (not shown). As soon as the leading edge of the pre-glued form 1 abuts against the second stop, the pre-glued is stopped but the second nip continues to convey the pre-glued form 1 through the second nip 34 of the folding apparatus 22 and such conveyance feeds a trailing portion of the pre-glued form 1 into the third nip 36. As the trailing end portion of the pre-glued form 1 passes through the third nip 36, a second fold is made in the pre-glued form 1 and the third nip 36 conveys the pre-glued form 1 to a collection bin (not numbered) where the folded pre-glued form 1 is collected and subsequently sealed by a further separate sealing process.

By passing the pre-glued form 1 through the four rollers 24, 26, 28 and 30 and the three nips 32,34,36 formed therebetween, the two folds are made in the pre-glued form 1. It is to be appreciated that the second roller 26, however, is generally a fixedly positioned roller, i.e. the second roller 26 is fixedly mounted to housing and not spring biased in any manner, while the first roller 24, the third roller 28 and the fourth roller 30 are each spring biased toward one another to accommodate for the thickness of the pre-glued form 1 as it passes between one of the three nips 32, 34, 36. That is, the first roller 24 is spring biased toward the second roller 26 and is moved slightly away from the second fixed roller 26 as the pre-glued form 1 passes through the first nip 32, the third roller 28 is spring biased toward the second roller 26 and moves slightly away from the second roller 26 as the pre-glued form 1 passes through the second nip 34, and the fourth roller 30 is spring biased toward the third roller 28 and moves slightly away from the third roller 28 as the pre-glued form 1 passes through the third nip 36.

As will be appreciated from the above discussion, the folding apparatus, according to the prior art, is only able to provide a folded pre-glued form 1 and a separate further sealing operation, e.g. passing the folded pre-glued form 1 through a sealing apparatus, is required in order to finish production of the pre-glued form 1 in its completely folded and sealed configuration.

SUMMARY OF THE INVENTION

Wherefore, it is an object of the present invention to overcome the above mentioned shortcomings and drawbacks associated with the prior art folding and sealing apparatuses.

Another object of the present invention is to provide a single apparatus which provides both a folding operation and a sealing operation to a pre-glued form during a single pass of the pre-glued form through the apparatus.

A further object of the present invention is to minimize the amount of associated rollers required to facilitate both the folding operation and the sealing operation of the pre-glued form as pre-glued form makes a single pass through the apparatus.

Still another object of the present invention is to provide a first and second fixed nips to provide a sufficient sealing pressure to the folded pre-glued form as the pre-glued form makes a single pass through the fixed nips of the apparatus.

A still further object of the present invention is to utilize at least three stainless steel rollers, or some other material which is substantially incompressible, as the final three pressure rollers of the folding and sealing apparatus to provide a sufficient sealing pressure to the pre-glued form.

Yet another object of the present invention is to arrange four rollers so as to form three nips between a mating surface of the four rollers, with the first and second nips cooperating with one another to provide a first initial fold for the pre-glued form while the second and third nip cooperating with one another to provide a second fold for the pre-glued form and the second and third nips providing a sufficient sealing pressure to the pre-glued form to facilitate sealing of the folded pre-glued form.

The present invention also relates to a folding and sealing apparatus comprising: a housing, the housing accommodating a plurality of rollers, the housing accommodating a motor for driving at least one of the plurality of rollers via a drive mechanism, a feed surface, supported by the housing, for feeding a supply of pre-glued forms to the folding and sealing apparatus, wherein the plurality of rollers form at least two nips each having a fixed nip clearance and the two fixed nips provide a sufficient sealing pressure to the folded pre-glued form, as the pre-glued form passes through the two fixed nips, to facilitate both folding and sealing of the pre-glued form as the folded pre-glued form passes through the two fixed nips.

The present invention also relates to a method of folding and sealing a pre-glued form by a single pass through a folding and sealing apparatus, the method comprising the steps of: providing a housing, accommodating a plurality of rollers within the housing, accommodating a motor, for driving at least one of the plurality of rollers via a drive mechanism, within the housing, providing a feed surface, supported by the housing, for feeding a supply of pre-glued forms to the folding and sealing apparatus, forming, via the plurality of rollers, at least two nips each having a fixed nip clearance and the two fixed nips providing a sufficient sealing pressure to the folded pre-glued form, as the pre-glued form passes through the two fixed nips, and facilitate both folding and sealing of the pre-glued form as the folded pre-glued form passes through the two fixed nips.

BRIEF DESCRIPTION OF THE DRAWINGS

The invention will now be described, by way of example, with reference to the accompanying drawings in which.

DESCRIPTION OF THE PREFERRED EMBODIMENT(S)

Figure 3:
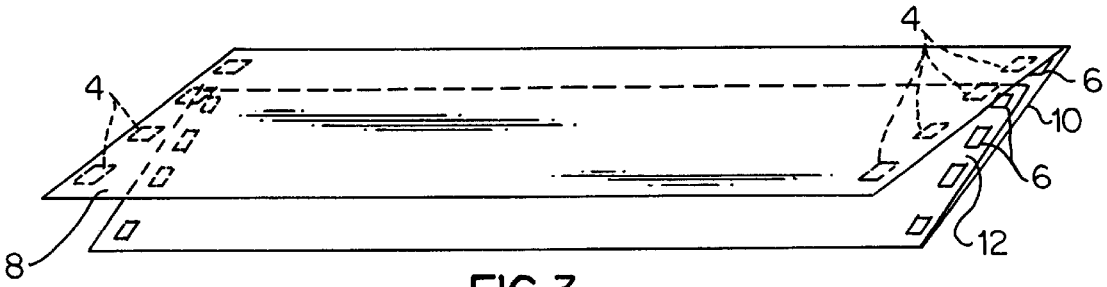
FIG. 3 is a diagrammatic perspective view showing the partially folding configuration for a letter type folded pre-glued form.
Figure 1:
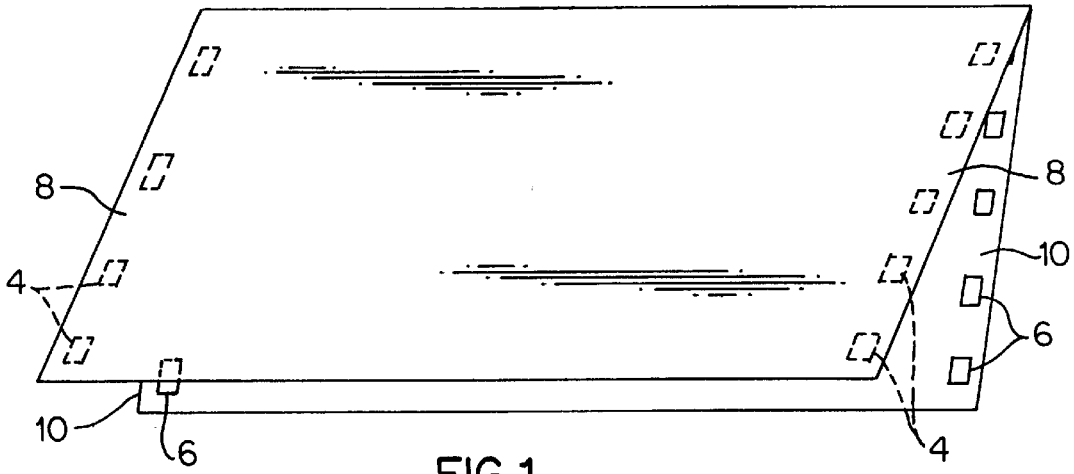
FIG. 1 is a diagrammatic perspective view showing the partially folding configuration for a single folded pre-glued form.
Figure 2:
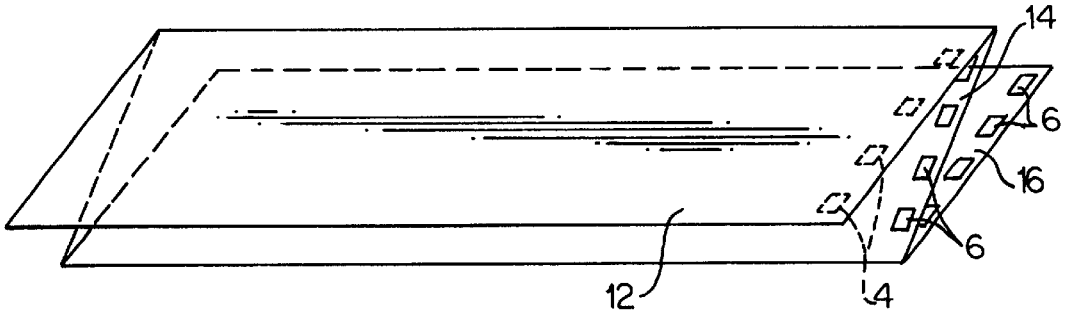
FIG. 2 is a diagrammatic perspective view showing the partially folded configuration for a Z-shaped folded pre-glued form.
Figure 4:
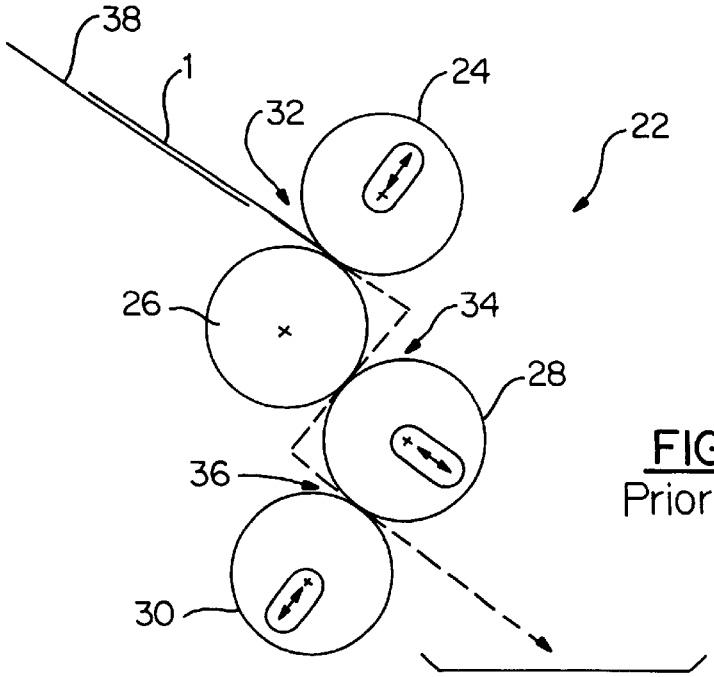
FIG.4 Prior Art
FIG. 4 is a diagrammatic section view showing a prior art apparatus for folding of a pre-glued form.
Figure 5:
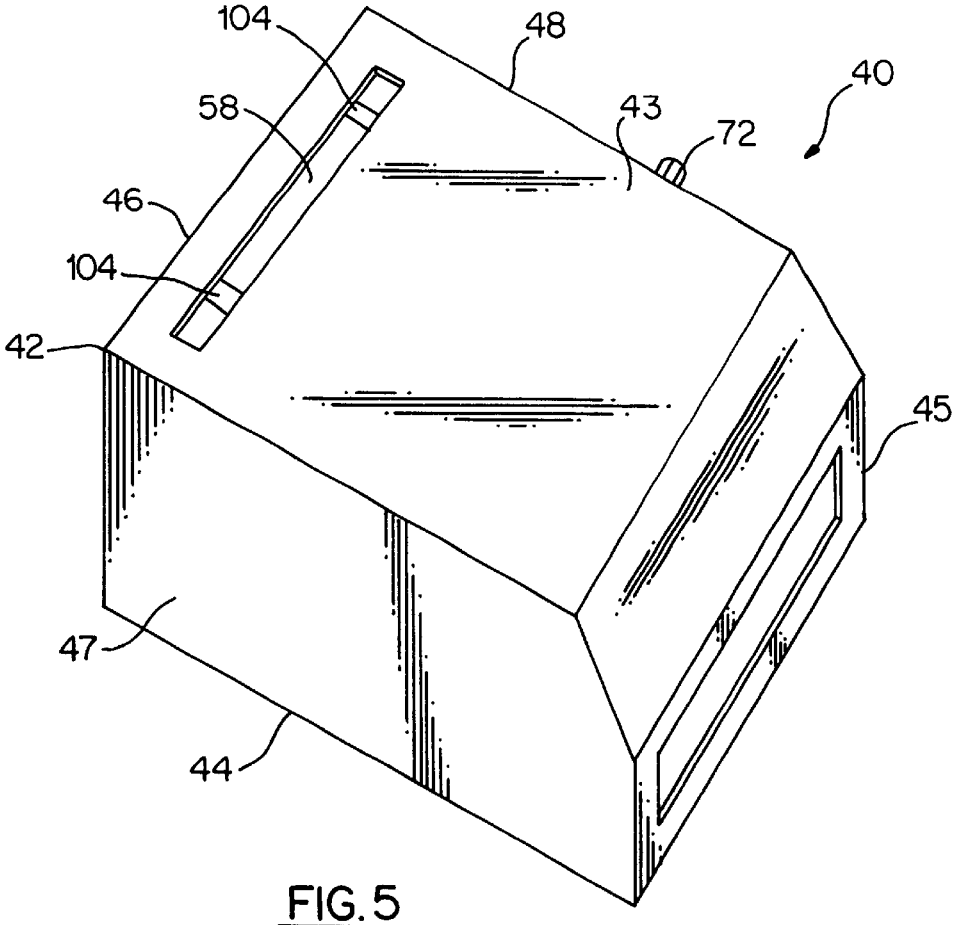
FIG. 5 is a diagrammatic perspective view of the folding and sealing apparatus according to the present invention.

With reference now to FIGS. 5 through 11, and FIGS. 5 through 7 in particular, a first embodiment of the folding and sealing apparatus, according to the present invention, will now be discussed in detail. The folding and sealing apparatus 40 generally comprises an exterior housing 42 having a top wall 43 and a bottom wall 44, a pair of opposed end walls 45, 46, and a pair of opposed sidewalls 47,48 which each support one end of a first roller 50, a second roller 52, a third roller 54 and a fourth roller 56, as will be described in further detail below. In addition, the folding and sealing apparatus 40 includes a feed cassette, feed platform, feed table or feed tray, generally designated as 58, for feeding a supply of pre-glued forms 1, to be folded, to the folding and sealing apparatus 40 as well as a collection bin, generally designated as 60, for collecting the completely folded and sealed pre-glued forms 1 once they pass through and exit the folding and sealing apparatus 40. If desired, a conveyor (see FIG. 11) may be provided, instead of the collection bin 60, for receiving the folded forms 1 as they are discharged from the outlet of the folding and sealing apparatus 40 and transport the folded forms 1 to another area for further processing.

As with the prior art, the four rollers 50, 52, 54 and 56 are all located and completely housed within the exterior housing 42 of the folding and sealing apparatus 40 for safety reasons. However, contrary to the prior art, the second, the third and the fourth rollers 52, 54 and 56 of the folding and sealing apparatus 40 are all fixedly supported or arranged rollers (i.e. the position and orientation of these rollers are preset at the manufacturing facility to maintain continuously a desired spacing between the respective rollers and eliminate any adjustment of the roller position(s) which typically is done by the operator of conventional fold and seal while the other remaining roller, i.e. the first roller 50 of the folding and sealing apparatus 40, is a spring biased roller which can separate slightly from its spring biased position when a pre-glued form 1 passes between the first roller 50 and the second roller 52. That is, the first roller 50 is spring biased toward the second roller 52 which is fixedly supported by a pair of opposed bearings (not numbered) mounted on the opposed side walls 47, 48 of the exterior housing 42. The pair of bearings facilitate rotation of the second roller 52. In a similar manner, the third and the fourth rollers 54 and 56 are also fixedly supported by a pair of opposed bearings (not numbered) mounted on the opposed side walls 47, 48 of the exterior housing 42. The two pairs of bearings (not numbered) facilitate rotation of the third and the fourth rollers 54 and 56. A first nip 51 is formed between the first and second rollers 50, 52, a second nip 53 is formed between the second and third rollers 52, 54, and a third nip 55 is formed between the third and fourth rollers 54, 56.

Figure 6:
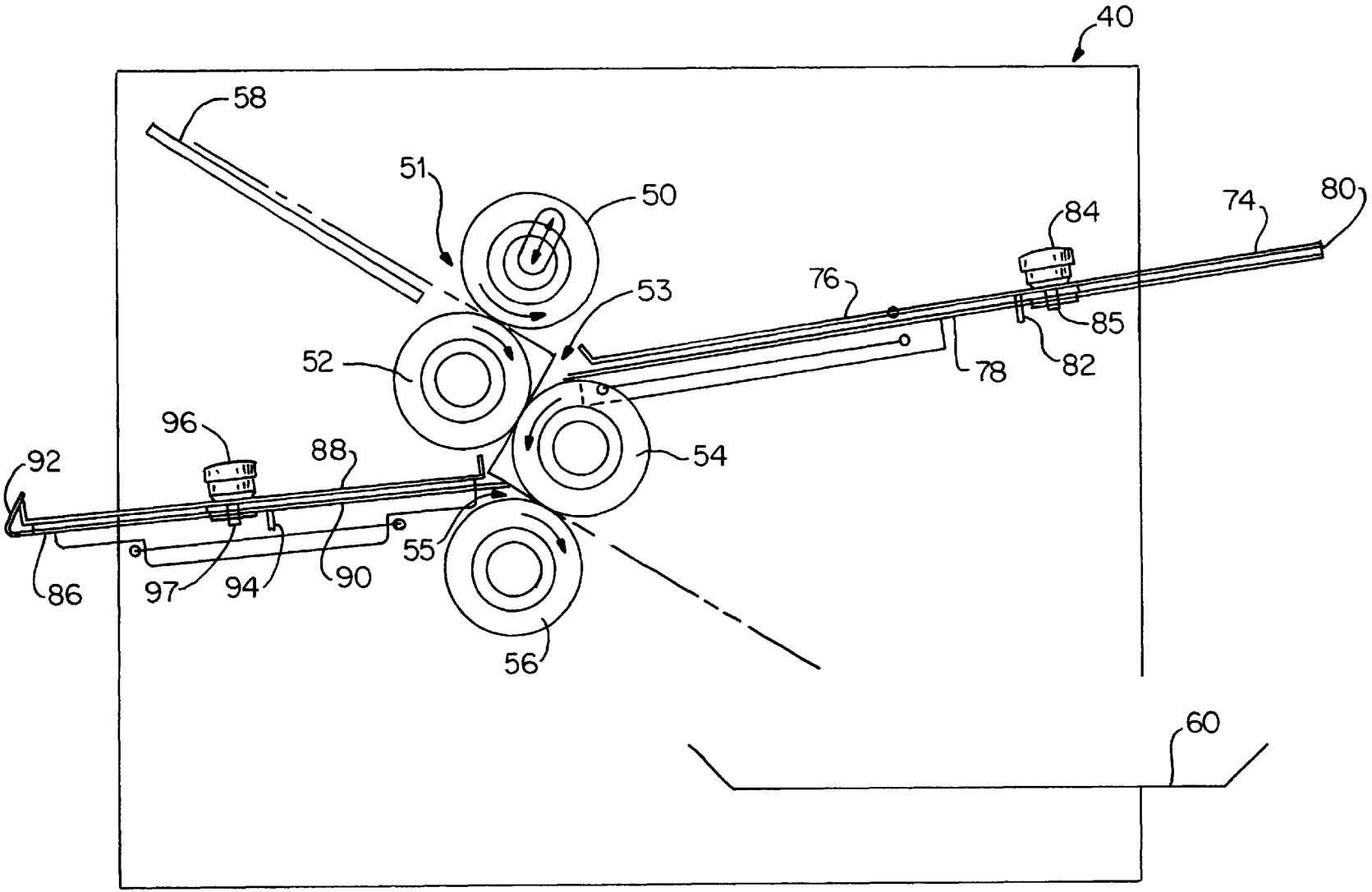
FIG. 6 is a diagrammatic cross section view showing the basic components of the folding and sealing apparatus of FIG. 5.
Figure 7:
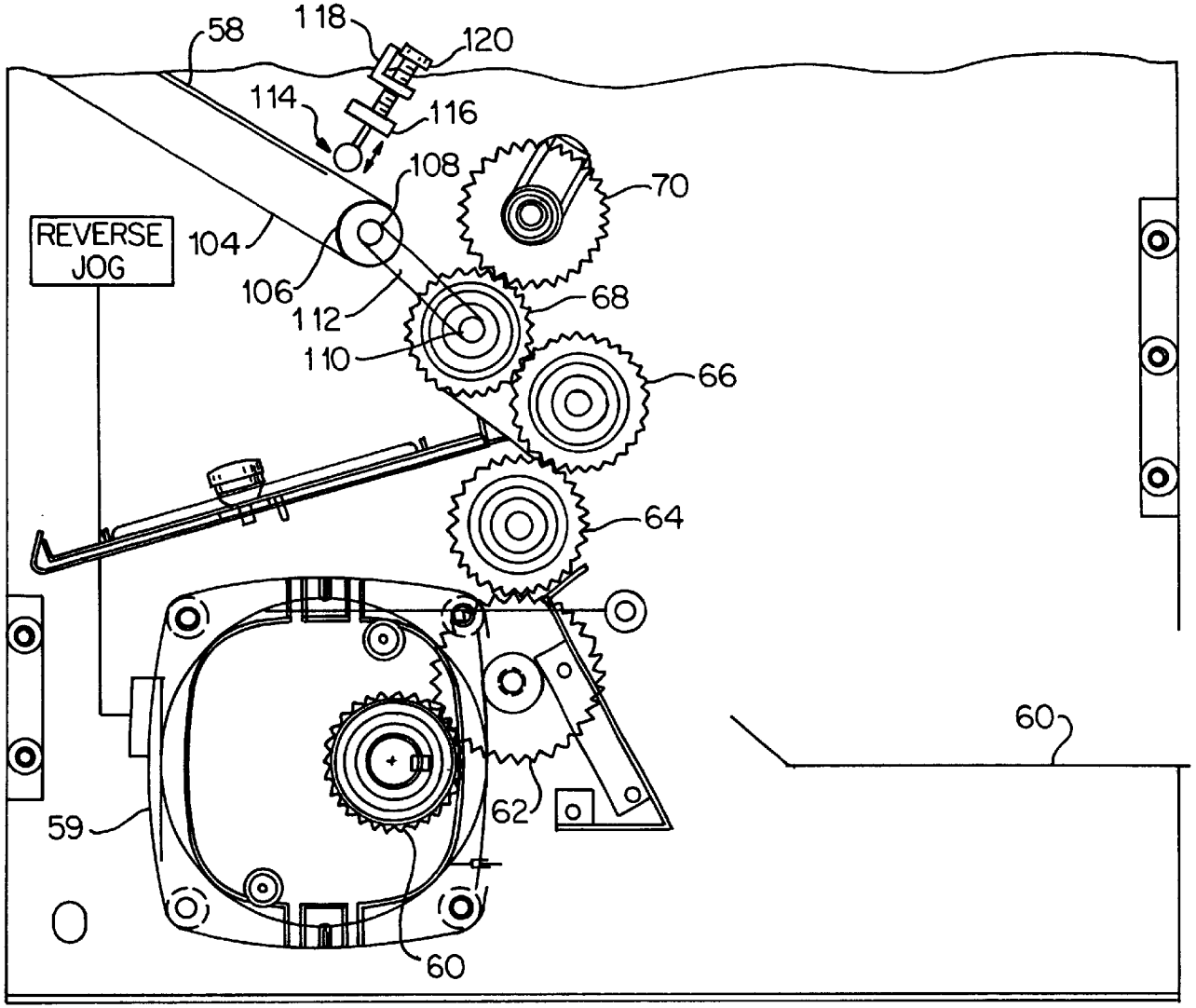
FIG. 7 is a diagrammatic cross section view showing the drive components of the folding and sealing apparatus of FIG. 5.
Figure 8:
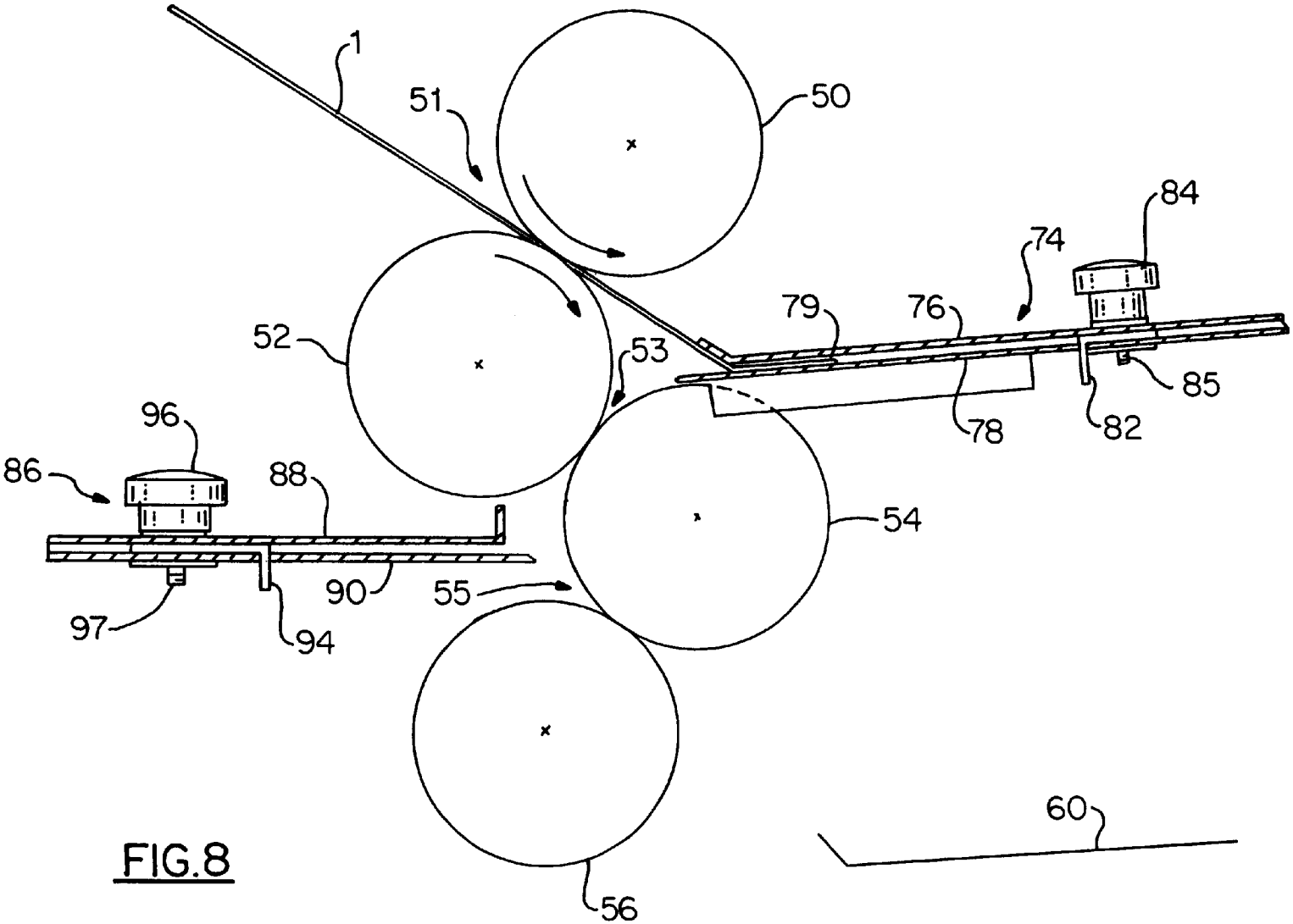
FIG. 8 is a diagrammatic cross-sectional view of the folding and sealing apparatus of FIG. 6 showing a first phase of the folding sequence for folding a pre-glued form.
Figure 9:
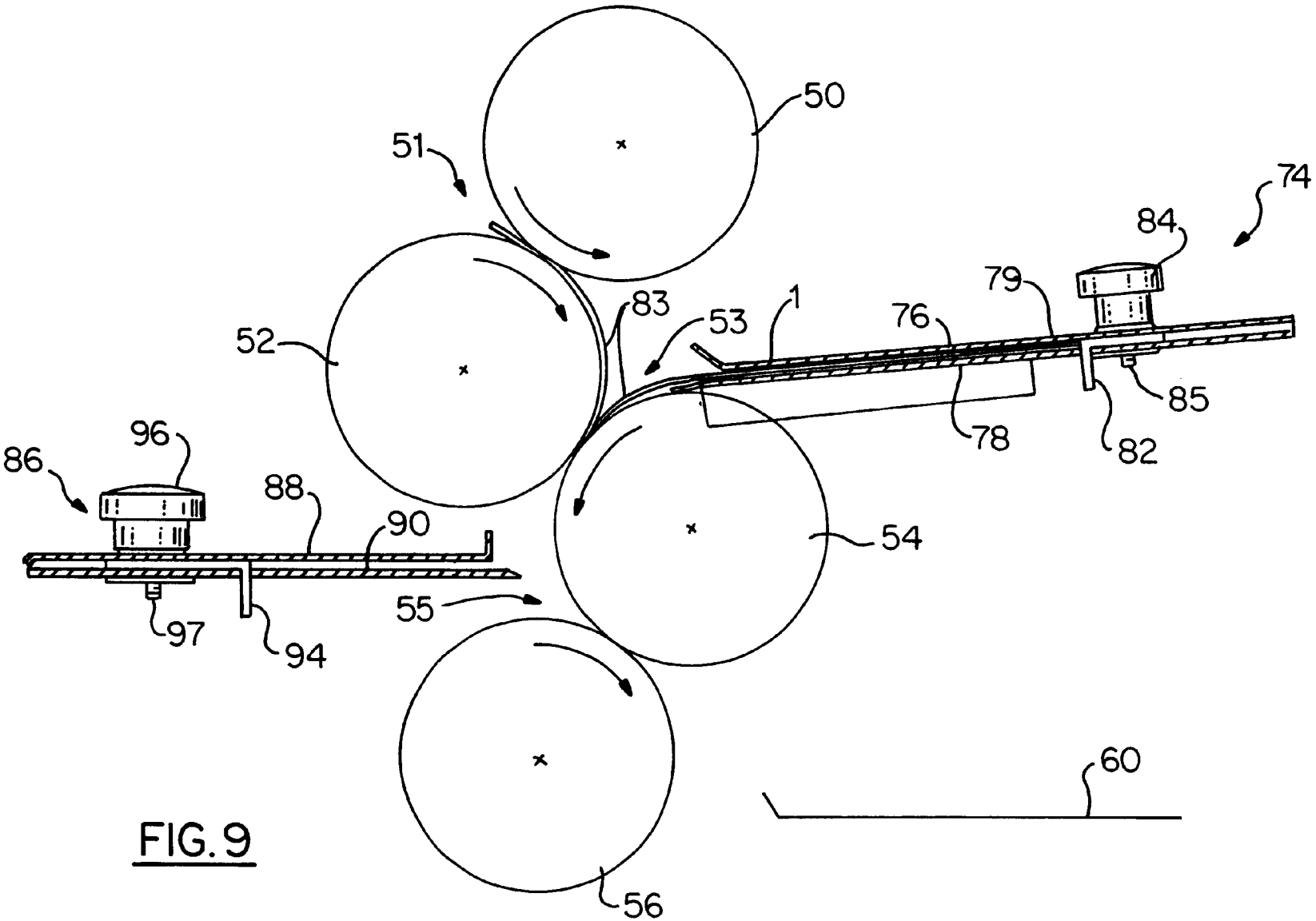
FIG. 9 is a diagrammatic cross-sectional view of the folding and sealing apparatus of FIG. 6 showing a second phase of the folding sequence for folding a pre-glued form.

A single motor 59 drives the first roller, the second roller, the third roller and the fourth roller 50, 52, 54 and 56 via a series of gears. An output shaft (not numbered) of the motor supports a first gear 60 and this first gear 60 directly drives an intermediate gear 62. The intermediate gear 62, in turn, directly drives a fourth gear 64 supported at one end of the fourth roller 56, adjacent one of the bearings, so as to rotate the fourth roller 56 in a clockwise direction (as can be seen in FIG. 6). The fourth gear 64 is also coupled to directly drive a third gear 66 supported at one end of the third roller 54, adjacent one of the bearings, so as to rotate the third roller 54 in a counterclockwise direction (as can be seen in FIG. 6). The third gear 66 is, in turn, directly coupled to a second gear 68 supported by one end of the second roller 52, adjacent one of the bearings, so as to rotate the second roller 52 in a clockwise rotation (as can be seen in FIG. 6). The second gear 68 is, in turn, directly coupled to a first gear 70 supported at one end of the first roller 50, adjacent one of the bearings, so as to rotate the first roller 50 in a counterclockwise rotation (as can be seen in FIG. 6). It is to be appreciated, that due to the gearing of the present invention, all of the four rollers 50, 52, 54 and 56 rotate simultaneously with one another and at constant and identical rotational speeds. Preferably, the first, the second, the third and the fourth rollers 50, 52, 54 and 56 all rotate at a rotational speed of between 40 to about 1200 revolutions per minute and more preferably rotation at a rotational speed of about 300 revolutions per minute during normal operation of the folding and sealing apparatus 40.

The motor 59 supplies a sufficient rotating torque to the third and fourth rollers 54, 56 to facilitate passing the pre-glued and folded form 1 therethrough and minimize the possibility of the third and fourth pressure rollers 54, 56 from becoming bound or jammed as a folded form 1 passes therethrough. The motor 59 is designed to provide a torque to the third nip 55, formed between the third and fourth rollers, 54, 56 and to the second nip 53, formed between the second and third rollers 52, 54, of about 60 to 90 inch pounds of torque. The motor 59 is preferably at least ⅓ to ¼ horsepower motor and is coupled to an electrical supply by either a conventional electrical cord or a conventional battery (not shown).

The second, the third and the fourth rollers 52, 54 and 56 are all preferably stainless steel rollers or rollers which are manufactured from some other material which has a substantially incompressible exterior surface so that a sufficient folding/sealing pressure is applied to the pre-glued form 1 as the form passes through the second nip 53 formed between the second and third rollers 52, 54 and as the pre-glued form 1 as the form passes through the third nip 55 formed between the third and fourth rollers 54, 56. It is to be appreciated that the first roller 50 can also be a stainless steel roller or manufactured from some other material which has a substantially incompressible exterior surface.

Preferably, the second and the third rollers 52 and 54 are spaced from one another by a distance of about 0.004±0.0005 inches so as to form a second nip 53 having a constant and uniform spacing along the entire elongate axial length of the second nip 53 and the third and fourth rollers 54 and 56 are likewise spaced from one another by a distance of about 0.004±0.0005 inches so as to form a third nip 55 having a constant and uniform spacing along the entire elongate length of the third nip 55. It is to be appreciated that the second and the third nips 53, 55, in order to provide the necessary folding and/or sealing pressure, must be substantially fixed nips, i.e. the spacing between the two the second and the third roller 52 and 54 and between the third and the fourth pressure rollers 54 and 56 must not change during operation, as the pre-glued and folded form 1 passes therethrough, so that a sufficient sealing pressure is generated on the pre-glued and folded form 1 so as to break the micro-capsules containing the first and second components of the pressure sensitive epoxy or adhesive 4 and 6 and adequately bond and seal the folded form 1.

In order to minimize damage and/or required service calls for the folding and sealing apparatus 40, it is desirable to provide at least one of the fixed rollers, either the second, the third and/or the fourth roller 52, 54 or 56 or possibly two or more of those rollers, with a release mechanism 72 (FIG. 5), e.g. a ⅝ inch hex head provided on an end of a shaft supporting one of the rollers, e.g. third roller 54. In the event that the folding and sealing apparatus 40 becomes bound or jammed, for some reason, as one of the pre-glued and folded forms 1 passes through the second or third nip 53 or 55, an operator may obtain and place a wrench on the release mechanism 72 and manually turn or rotate the bound rollers in either a forward direction or a reverse direction to remove the jammed pre-glued and folded form 1 and unbind the folding and sealing apparatus 40. By providing the operator of the folding and sealing apparatus 40 with the ability to rotate the third and fourth rollers manually, this minimizes the possibility of the operator having to call a maintenance person to maintain the folding and sealing apparatus 40 in a peak operating condition. In addition, the motor 59 may be electrically coupled to a control panel equipped with "reverse jog" button which reverses the drive direction of the motor 59 to facilitating freeing the jammed pre-glued and folded form 1 from the pair of rollers and unbind the folding and sealing apparatus 40.

A first fold channel tray is provided along a travel path between the first and second nips 51 and 53. The first fold channel tray 74 comprises a top tray wall 76, an opposed bottom tray wall 78, a pair of opposed side tray walls (not numbered) and an end tray wall 80. The first fold channel tray 74 is sized to accommodate an 8½ inch wide sheet of paper, i.e. the opposed tray side walls are spaced from one another by a distance slightly greater than 8½ inches. The top tray wall 76 is spaced from the bottom tray wall 78 typically by a distance of about 1/16 of an inch to about ½ of an inch or so to provide a sufficient area for receiving a leading edge 79 of the pre-glued form 1. A first adjustable fold stop 82 is accommodated by the first fold channel 74 and the adjustable fold stop 82 is axially movable along the length of the first fold channel 74, as discussed below in further detail, to a desired position.

In addition, the folding and sealing apparatus 40 includes a second fold channel tray 86 provided along a travel path between the second and third nips 53 or 55. The second fold channel tray 86 also comprises a top tray wall 88, an opposed bottom tray wall 90, a pair of opposed side tray walls (not numbered) and an end tray wall 92. The second fold channel tray 86 is also sized to accommodate an 8½ inch wide sheet of paper, i.e. the opposed tray side walls are spaced from one another by a distance greater than 8½ inches. The top tray wall 88 is spaced from the bottom tray wall 90 typically by a distance of about 1/16 of an inch to about 1½ of an inch or so to provide a sufficient area for receiving the leading edge 79 of the pre-glued and partially folded form 1. Another adjustable fold stop 94 is accommodated by the second fold channel 86 and the adjustable fold stop is axially movable along the length of the second fold channel, as discussed below in further detail, to a desired position.

The first and second adjustable fold stops 82, 94, of the first and the second fold channel trays 74, 86, are each movable axially along the length of the respective fold channel trays by as distance between 0 to 15 inches depending on the length of the document to facilitate adjustment of the width of the fold of the form 1 to be achieved by the respective fold channel tray 74, 86. To facilitate such adjustment, the top surface 76, 88 of each fold channel tray has at least one elongate aperture or slot (not shown) formed therein which allows a projecting screw 85 or 97, carried by an adjustable knob 84 or 96, to pass therethrough. The projecting screws 85 or 97 each engage with a mating threaded nut (not numbered) provided on the adjustable fold stops 82, 94 and, once the respective nut is sufficiently tightened, the nut maintains the adjustable fold stops 82, 94 in a desired adjusted location.

Due to this arrangement, an operator can adjust the length of the fold to be made in the form 1 to be folded by loosening the knobs 84, 96, moving the adjustable fold stop(s) 82 or 94 axially along the fold channel tray 74, 86 to a desired location and then re-tightening the adjustable fold stop 82, 94 at that desired position by a tightening rotation of the knobs 84, 96. The length of the first fold for the pre-glued form 1 is determined by the distance from the facing surface of the first adjustable stop 82, of the first fold channel tray 74, to the second nip 53 while the length of the second fold for the pre-glued form 1 is determined by the distance from the facing surface of the second adjustable stop 94, of the second fold channel tray 86, to the third nip 55.

When folding of a pre-glued form 1 is wanted, a desired supply of the pre-glued form(s) 1 to be folded and sealed is placed on the in-feed table or platform 58. Thereafter, the folding and sealing apparatus 40 is activated and a leading edge 79 of the pre-glued form 1 is fed, by the first and second rollers 50, 52, into the first nip 51. The leading edge 79 of the pre-glued form 1 exits from the first nip 51 and the first and second rollers 50 (FIG. 8), 52 continue feeding the pre-glued form 1 until the leading edge 79 of the pre-glued form 1 contacts the first adjustable fold stop 82 of the first fold channel tray 74. Once this occurs (FIG. 9), continued feeding rotation of the first and second rollers 50, 52 causes an intermediate leading portion 83 of the pre-glued form 1 to accumulate in an area located immediately adjacent the second nip 53, formed between the second and third rollers 52, 54.

Once a sufficient amount of the intermediate leading portion 83 of the pre-glued form 1 has accumulated in the area immediately adjacent the second nip 53, the clockwise rotation of the second roller 52 and the counterclockwise rotation of the third roller 54 cause the intermediate leading portion 83 of the pre-glued form 1 to enter the second nip 53 and form a first fold in the pre-glued form 1 as intermediate leading portion 83 passes through the second nip 53. In addition, as the second and third rollers 52, 54 are both fixedly mounted rollers, those two rollers are not biased away from one another, as the pre-glued form 1 passes through the second nip 53, and thus the second and third rollers 52, 54 also apply a sufficient contact pressure to the pre-glued form 1 so as to seal, at least partially, the pre-glued form 1 in its partially folded configuration as the pre-glued form 1 passes through the second nip 53.

Figure 10:
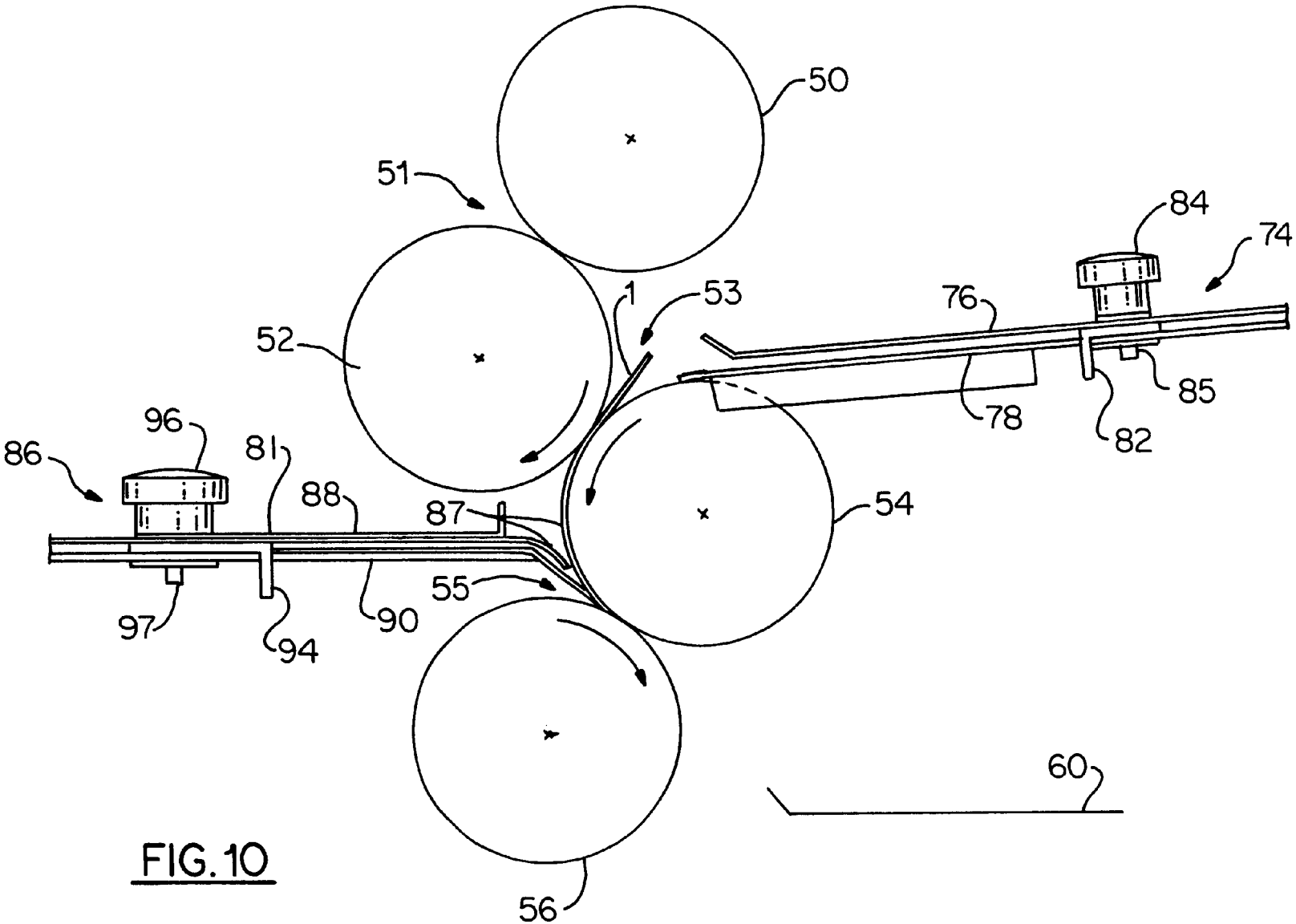
FIG. 10 is a diagrammatic cross-sectional view of the folding and sealing apparatus of FIG. 6 showing a third phase of the folding sequence for folding a pre-glued form.
Figure 11:
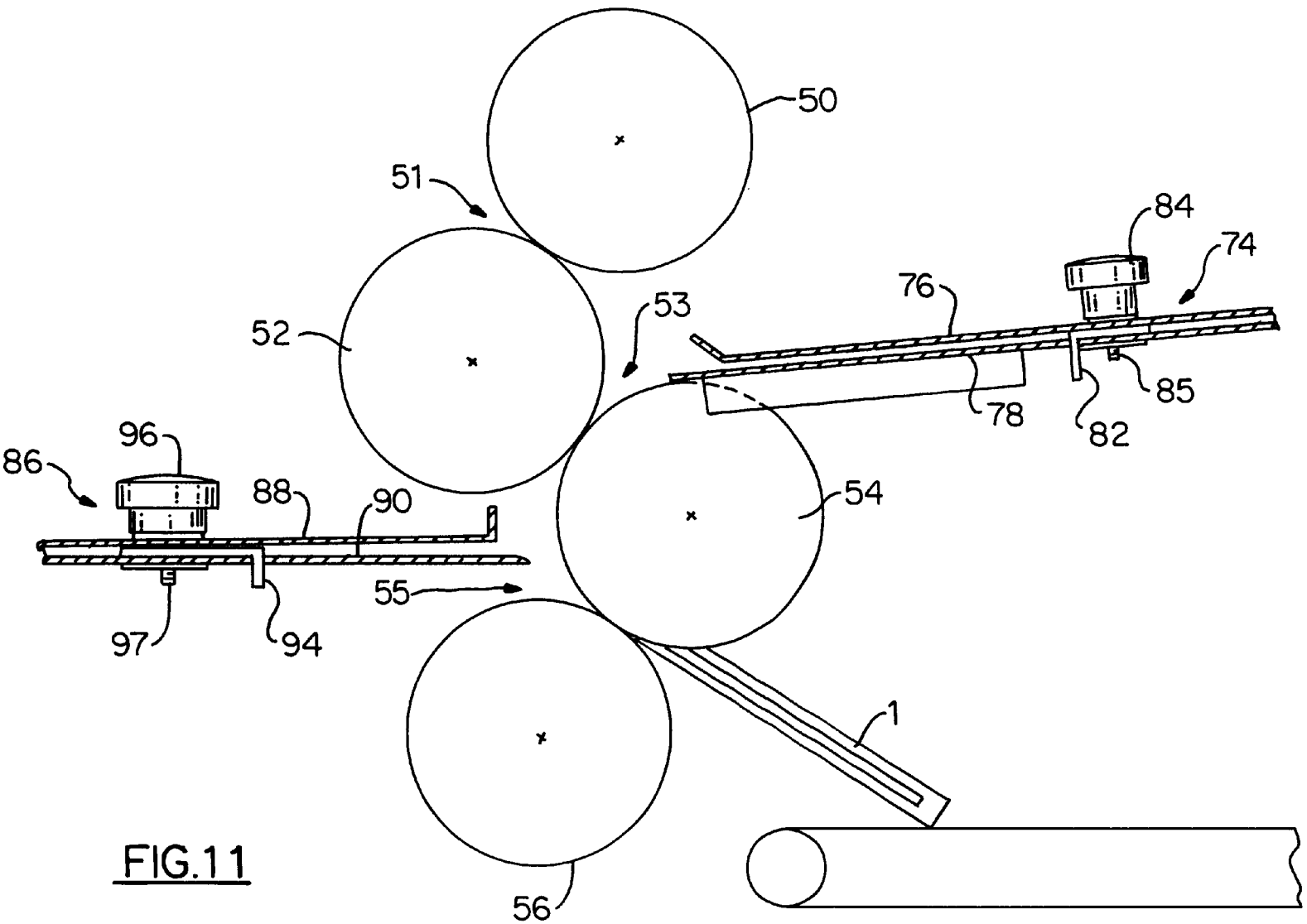
FIG. 11 is a diagrammatic cross-sectional view of the folding and sealing apparatus of FIG. 6 showing a fourth phase of the folding sequence for folding a pre-glued form with a conveyor substituted in place of the collection bin.

A leading folded edge 81 of the partially folded pre-glued form 1 exits the second nip 53 and is conveyed, due to the clockwise rotation of the second roller 52 and the counterclockwise rotation of the third roller 54, toward the second adjustable stop 94 of the second fold channel tray 86 (FIG. 10). Once the leading folded edge 81 of the pre-glued form 1 contacts the second adjustable fold stop 94, the pre-glued form 1 is prevented from further advancement within the second fold channel tray 86 and thus a trailing intermediate portion 87 of the pre-glued form 1 begins to accumulate in an area immediately adjacent the third nip 55, formed between the third and fourth rollers 54, 56. After a sufficient amount of the trailing intermediate portion 87 of the pre-glued form 1 has accumulated in the area immediately adjacent the third nip 55, the counterclockwise rotation of the third roller 54 and the clockwise rotation of the fourth roller 56 cause the trailing intermediate portion 87 of the pre-glued form 1 to enter the third nip 55 and form a second fold in the pre-glued form 1 as the pre-glued form 1 passes through the third nip 55. In addition, as the third and fourth rollers 54, 56 are both fixedly mounted rollers, those two rollers are not biased away from one another, as the pre-glued form 1 passes through the third nip 55, and thus the third and fourth rollers 54, 56 also apply a sufficient contact pressure to the pre-glued form 1 so as to completely seal the pre-glued form 1 in its folded configuration as the pre-glued form passes through the third nip 55. When the pre-glued and folded form 1 exits the third nip 55, it is collected in a collection bin 60 for further handling or processing by the operator.

In the event that only a half fold is required, the second fold channel tray 86 is removed from the housing, rotated or turned around 180° and then reinserted back into the housing 42, end tray wall 92 first, so that a rear surface of the end tray wall 92 of the second fold channel tray 86 is located closely adjacent and between both the second and fourth rollers 52 and 56 to deflect and redirect the partially folded pre-glued form 1, as the pre-glued form 1 exits from the second nip 53, toward the third nip 55.

When folding of a pre-glued form 1 is wanted, a desired pre-glued form 1 to be folded and sealed is placed on the in-feed table or platform 58 and the pre-glued forms 1 each pass through the first and second nips 51 and 53 in the same manner discussed above. However, due to the reverse configuration of the second fold channel tray 86, as the leading folded edge 81 of the partially folded pre-glued form 1 exits the second nip 53, formed by the second and third rollers 52, 54, the leading folded edge 81 of the partially folded pre-glued form 1 contacts the adjacent facing rear surface of the second fold channel tray 86 and is deflected by that surface directly toward and into the third nip 55 formed between the third and fourth rollers 54, 56. Accordingly, only a single fold is provided to the pre-glued form 1 and, as the folded pre-glued form 1 passes through the third nip 55, a further sealing pressure is provided to the folded pre-glued form 1 to seal further the pre-glued form 1 in its previously folded configuration.

As will appreciated by the above discussion, by merely reversing the orientation of the second fold channel tray 86, only a single fold is automatically provided by the same folding and sealing apparatus 40. Preferably the first fold channel tray 74 is also releasably secured to and retained by the housing 42 of the folding and sealing apparatus 40 to facilitate reversal thereof in the same manner as the second fold channel tray 86.

Figure 12:
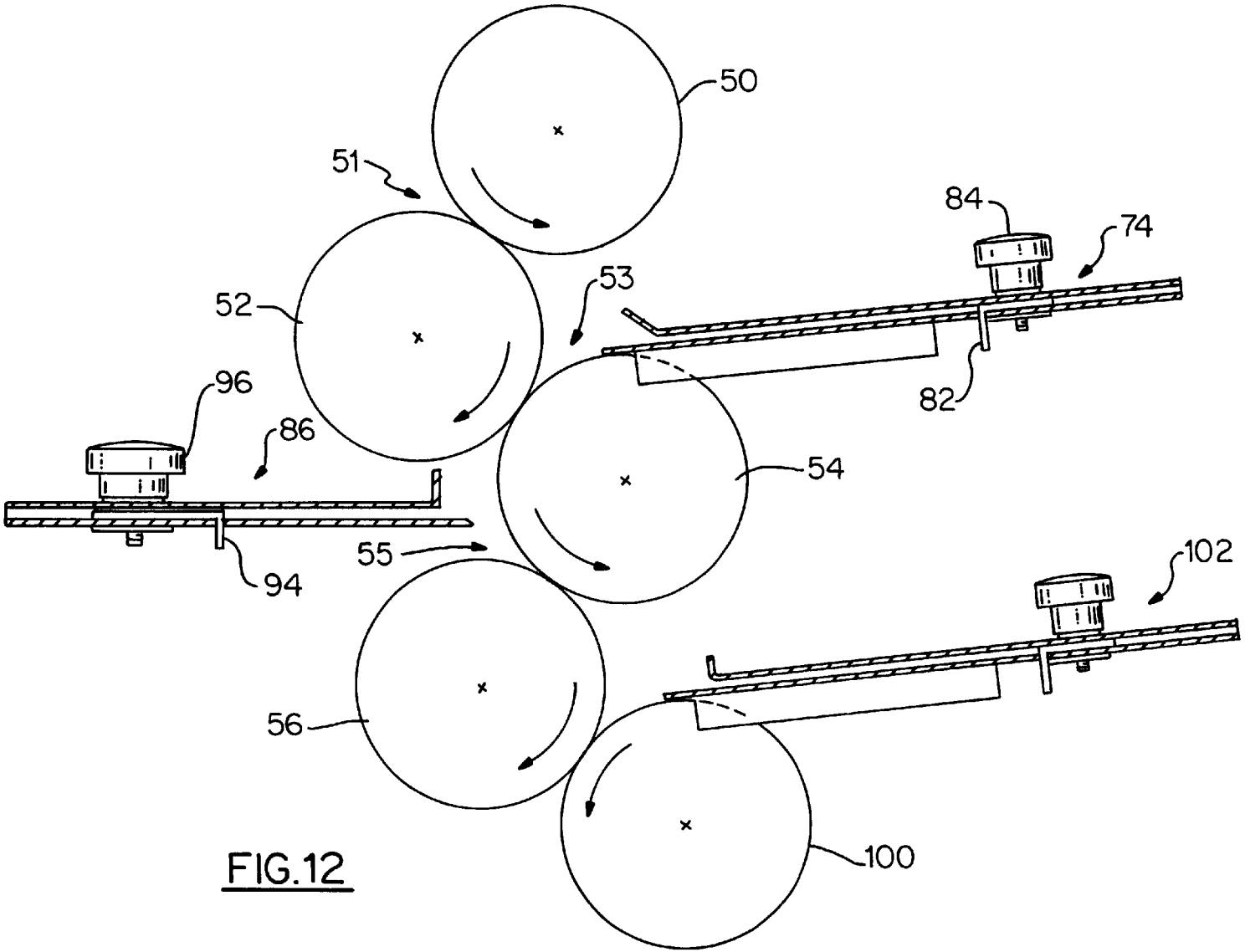
FIG. 12 is a diagrammatic cross section view showing the basic components of a second embodiment of the folding and sealing apparatus according to the present invention.

With reference now to FIG. 12, a second embodiment of the present invention will now be briefly discussed. As this embodiment is very similar to the previous embodiment, only a detailed discussion concerning the differences between this embodiment and the previous embodiment will be provided. The major difference between this embodiment and the previous embodiment is the addition of one additional fixed roller, e.g. a fifth roller 100, and one additional fold channel tray 102. By the addition of a further fixed roller 100 and a further fold channel tray 102, the folding and sealing apparatus 40, according to the present invention, is able to provide a third fold to the pre-glued form 1 during a single pass of the pre-glued form 1 through the folding and sealing apparatus 40. The fifth roller 100 is supported by a pair of opposed bearings (not numbered) mounted on the opposed side walls 47, 48 of the exterior housing 42 and the fifth roller 100 is fixedly spaced from the fourth roller 56. A fifth gear (not shown), supported at one end of the fifth roller 100, adjacent one of the bearings (not shown), is driven by the intermediate gear 62 in a counter clockwise direction and the fifth gear drives the fourth gear 64 at the same rotational speed and in a similar manner to the other four rollers 50, 52, 54 and 56 and the third fold channel tray 102 is substantially identical in function and operation to the first and second fold channel trays 74, 86. It is to be appreciated that, depending upon the final amount of folds to be provided to the pre-glued form 1, the number of rollers and associated fold channel trays can be increased, as necessary, and such modification would be readily apparent to those skilled in this art.

When the pre-glued form 1 is folded over in half, the thickness of the form generally measures between about 0.005 to about 0.015, depending upon the thickness of the paper utilized to manufacture the pre-glued form 1, while when the form is folded over into the Z-shaped or letter type configuration, the folded pre-glued form 1 has a thickness ranging from about 0.009 to about 0.020 or more. By providing a clearance for the second and third nips 53, 55 of only about 0.004±0.0005, according to the present invention, a sufficient sealing pressure is provided to the pre-glued form 1 to insure that the micro-capsules, containing the pressure sensitive epoxy or adhesive, are quickly broken to release the two mating components of the epoxy or adhesive and generate the desired bond between the mating surfaces of the folded form.

It is to be appreciated that the folding and sealing apparatus of the present invention could also be used only to fold forms, i.e. used as a standard folder, rather than to both fold and seal forms if an insufficient sealing pressure is applied to the folded form to release and mix the encapsulated glue or if standard paper, without any glue, is passed through the folding and sealing apparatus.

To assist with feeding the supply of pre-glued forms 1, to be folded, to the folding and sealing apparatus 40 (FIGS. 5 and 7), the feed platform 58 has a pair of spaced apart feed belts 104, supported by a pair of spaced apart shafts 106 (only one of which is shown). One of the shafts supports a first pulley 108 and the second roller 52 supports a mating second pulley 110. A drive belt 112 rotates around the pair of pulleys 108, 110 to supply rotational drive from the second gear 68 to the pair of pulleys in a conventional manner. By this arrangement, the pair of spaced apart rotatable belts 104 rotate along with the first and second rollers 50 and 52 to assist with sequentially feeding the supply of pre-glued forms 1 to be folded one after another through the first nip 51.

The feed platform 58 also has a centrally located form retarder device 114, preferably manufactured from DELRIN® or some other similar material, to facilitate supplying only one pre-glued form 1 at a time to the first nip 51. The form retarder device 114 is fixed support by a first cross bar 116, located adjacent the feed platform 58, while a second reinforced cross bar 118 is spaced further from the feed platform 58 than the first cross bar 116. The second reinforced cross bar 118 supports a thread member 120 located to engage with a rear surface of the first cross bar 116 facing away from the feed platform 58 and exert pressure thereon. As pressure is applied to the first cross bar 116, via the thread pressure member 120 of the second reinforced cross bar 118, the first cross bar 116 starts to bow and gradually move the supported form retarder device 114 toward the feed platform 58 thereby reducing the clearance between the form retarder device 114 and a top surface of the feed platform 58. Alternatively, if the pressure applied to the first cross bar 116, via the thread pressure member 120 of the second reinforced cross bar 118, is decreased, the first cross bar 116 then moves back toward its unstressed condition and gradually moves the form retarder device 114 away from the top surface of the feed platform 58 thereby increasing the clearance between the form retarder device 114 and the top surface of the feed platform 58.

Since certain changes may be made in the above described improved the folding and sealing apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A folding and sealing apparatus comprising:

a housing for the folding and sealing apparatus;

a first roller, a second roller, a third roller and a fourth roller rotatably supported by the housing;

a drive mechanism coupling at least the second, the third and the fourth rollers to one another so that at least the second, the third and the fourth rollers all rotate simultaneously with one another;

a motor being accommodated by the housing, and the motor coupled to the drive mechanism for driving the second, the third and the fourth rollers simultaneously with one another;

a feed surface, supported by the housing, for feeding a supply of pre-glued forms to the first and second rollers;

wherein the first roller is spring biased toward the second roller to form a spring biased variable width first nip, the third roller is supported by the housing a fixed distance away from the second roller to form a fixed constant width second nip, and the fourth roller is supported by the housing a fixed distance away from the third roller to form a fixed constant width third nip, and the fixed constant width second and third nips provide a sufficient sealing pressure to the folded pre-glued form, as the pre-glued form passes through the fixed constant width second and third nips, to facilitate both folding and sealing of the pre-glued form as the folded pre-glued form passes therethrough.

2. The folding and sealing apparatus according to claim 1, wherein a collection bin is provided adjacent an outlet of the third nip for collecting the folded and sealed form as the folded and sealed form exits from the folding and sealing apparatus.

3. The folding and sealing apparatus according to claim 1, wherein the motor is a single motor which drives the drive mechanism so that the second roller and the fourth roller rotate in a first direction while the third roller rotate in an opposite direction.

4. The folding and sealing apparatus according to claim 1, wherein the second roller, the third roller and the fourth roller all have the same diameter.

5. The folding and sealing apparatus according to claim 3, wherein the first roller, the second roller, the third roller and the fourth roller are all geared to rotate, during operation of the folding and sealing apparatus, at the same rotational speed.

6. The folding and sealing apparatus according to claim 1, wherein the second roller is spaced from the third roller by a distance of about 0.004 inches to form the constant width second nip, and the fourth roller is spaced from the third roller by a distance of about 0.004 inches to form the constant width third nip.

7. The folding and sealing apparatus according to claim 6, wherein the first roller, the second roller, the third roller and the fourth roller all have a diameter of between about 1 inch to about 3 inches and the first roller, the second roller, the third roller and the fourth roller all rotate at a rotational speed of between 40 to about 1200 revolutions per minute.

8. The folding and sealing apparatus according to claim 1, wherein a first spring provides a force for biasing the first roller toward the second roller, and a tension of the first spring is adjustable to adjust the biasing force of the first roller toward the second roller and facilitate control of a pressure of the first nip.

9. The folding and sealing apparatus according to claim 1, wherein a first fold channel tray is located between the first nip and the second nip to assist with forming a first fold in the pre-glued form, and the first fold channel tray has an adjustable fold stop for adjusting a first fold length to be made in the pre-glued form during operation of the folding and sealing apparatus; and a second fold channel tray is located between the second nip and the third nip to assist with forming a second fold in the pre-glued form, and the second fold channel tray has an adjustable fold stop for adjusting a second fold length to be made in the pre-glued form during operation of the folding and sealing apparatus.

10. The folding and sealing apparatus according to claim 9, wherein a collection bin is provided adjacent an outlet of the third nip for collecting the folded and sealed form as the folded and sealed form exits from the folding and sealing apparatus.

11. The folding and sealing apparatus according to claim 9, wherein at least the second fold channel tray is releasably secured to the housing to facilitate reversal thereof.

12. The folding and sealing apparatus according to claim 9, wherein both the first and the second fold channel trays are releasably secured to the housing to facilitate reversal thereof.

13. The folding and seeing apparatus according to claim 4, wherein the second roller, the third roller and the fourth roller each have a stainless steel exterior surface to facilitate sealing of the folded form as the folded form passes through the second nip and the third nip.

14. The folding and sealing apparatus according to claim 2, wherein a conveyor is provided adjacent an outlet of the third nip for collection of the folded and sealed pre-glued forms upon exiting from the folding and sealing apparatus and conveying the folded and sealed form to facilitate for further processing of the folded and sealed form.

15. A folding and sealing apparatus comprising:

a housing for the folding arid sealing apparatus;

a first roller, a second roller, a third roller and fourth roller rotatably supported by the housing;

a drive mechanism coupling at least the second, the third and the fourth rollers to one another so that at least the second, the third and the fourth rollers all rotate simultaneously with one another;

a motor being accommodated by the housing, and the motor coupled to the drive mechanism for driving the second, the third and the fourth rollers simultaneously with one another such that the second roller and the fourth roller rotate in a first direction while the third roller rotate in an opposite direction;

a feed surface, supported by the housing, for feeding a supply of pre-glued forms to the first and second rollers;

wherein the first roller is spring biased toward the second roller to form a spring biased variable width first nip, the third roller is supported by the housing a fixed distance away from the second roller to form a fixed constant width second nip of about 0.004 of an Inch, and the fourth roller is supported by the housing a fixed distance away from the third roller to form a fixed constant width third nip of about 0.004 of an inch, and the fixed constant width second and third Mps provide a sufficient sealing pressure to the folded pre-glued form, as the pre-glued form passes through the fixed constant width second and third nips, to facilitate both folding and sealing of the pre-glued form as the folded pre-glued form passes therethrough; and a first spring provides a force for biasing the first roller toward the second roller, and a tension of the first spring is adjustable to adjust the biasing force of the first roller toward the second roller and facilitate control of a pressure of the first nip.

16. The folding and sealing apparatus according to claim 15, wherein a first fold channel tray is located between the first nip and the second nip to assist with forming a first fold in the pre-glued form, and the first fold channel tray has an adjustable fold stop for adjusting a first fold length to be made in the pre-glued form during operation of the folding and sealing apparatus; and a second fold channel tray is located between the second nip and the third nip to assist with forming a second fold in the pre-glued form, and the second fold channel fray has an adjustable fold stop for adjusting a second fold length to be made in the pre-glued form during operation of the folding and sealing apparatus.

17. The folding and sealing apparatus according to claim 16, wherein a collection bin is provided adjacent an outlet of the third nip for collecting the folded and sealed form as the folded and sealed form exits from the folding and sealing apparatus.

18. The folding and sealing apparatus according to claim 17, wherein both the first and the second fold channel trays are releasably secured to the housing to facilitate reversal thereof.

19. The folding and sealing apparatus according to claim 17, wherein the second roller, the third roller and the fourth roller each have a stainless steel exterior surface to facilitate sealing of the folded form as the folded form passes through the second nip and the third nip.

20. A method of folding and sealing a pre-glued form by a single pass through a folding and sealing apparatus, the method comprising the steps of:

providing a housing;

rotatably supporting a first roller, a second miter, a third roller and a fourth roller by the housing;

coupling a drive mechanism to at least the second, the third and the fourth rollers so that at least the second, the third and the fourth rollers all rotate simultaneously with one another;

accommodated a motor by the housing, and coupling the motor to the drive mechanism for driving the second, the third and the fourth rollers simultaneously with one another;

supporting a feed surface by the housing for feeding a supply of pre-glued forms to the first and second rollers;

spring biasing the first roller toward the second roller to form a spring biased variable width first nip;

fixedly supporting the third roller by the housing a fixed distance away from the second roller to form a fixed constant width second nip; and fixedly supporting the fourth roller by the housing a fixed-distance away from the third roller to form a fixed constant width third nip, whereby the fixed constant width second and third nips provide a sufficient sealing pressure to the folded pre-glued form, as the pre-glued form passes through the fixed constant width second and third nips, to facilitate both folding and sealing of the pre-glued form as the folded pre-glued form passes therethrough.

* * * * *